United States Patent [19]

Grasso

[11] Patent Number: 4,869,503

[45] Date of Patent: Sep. 26, 1989

[54] FIELD GAME

[76] Inventor: Mark Grasso, 118 Buccaneer St., No. C, Marina del Rey, Calif. 90292

[21] Appl. No.: 185,795

[22] Filed: Apr. 25, 1988

[51] Int. Cl.[4] ..... A63B 69/34

[52] U.S. Cl. ..... 273/55 A; 273/411; 273/94; 446/396

[58] Field of Search ..... 273/55 R, 55 A, 411, 273/55 D, 1 B, 1.5 R, 1.5 A, 94, 85 R, 390, 391, 407, 409, 26 R, 26 A, 26 D, 89, 90, 127 R, 127 B; 40/598, 602, 538, 536, 411, 608, 409, 421; 434/251; 404/10; 446/325, 396

[56] References Cited

U.S. PATENT DOCUMENTS

| | | | |
|---|---|---|---|
| 1,549,156 | 8/1925 | Shoemaker | 40/538 |
| 1,884,816 | 10/1932 | Oakes | 273/55 A |
| 3,091,459 | 5/1963 | Lindman | 273/90 |
| 3,181,261 | 5/1965 | Swartz | 40/411 |
| 3,371,647 | 3/1968 | Shopbell | 40/598 |
| 3,379,441 | 4/1968 | Feather et al. | 273/94 R |
| 3,558,135 | 1/1971 | Rees et al. | 273/55 A |
| 3,573,867 | 4/1971 | Mehrens | 273/55 R |
| 3,680,861 | 8/1972 | Schmidt | 273/55 R |
| 3,969,837 | 7/1976 | Kresse | 40/538 |
| 4,078,867 | 3/1978 | Ronden | 404/10 |
| 4,145,044 | 3/1979 | Wilson et al. | 273/1.5 R |
| 4,489,940 | 12/1984 | Amundson | 273/1 B |

*Primary Examiner*—Edward M. Coven
*Assistant Examiner*—S. Passaniti
*Attorney, Agent, or Firm*—Spensley Horn Jubas & Lubitz

[57] ABSTRACT

The game utilizes free-standing game pieces to enhance a player's options when there are a less than a desirable number of participants for a traditional field game. Each of the game pieces is composed of a lightweight material for easy positioning. The game pieces are large enough to serve as both a target and an obstacle. The game pieces are also constructed with a flexible support means to both cushion contact with a human player or the game object and lessen the possibility of the game pieces breaking upon such contact. The game pieces are connected to a base that disconnects upon contact capable of breaking the support means. Rules for use of the game pieces are also disclosed.

12 Claims, 2 Drawing Sheets

FIELD GAME

BACKGROUND OF THE INVENTION

1. Field of the Invention

The present invention relates to field games, and more particularly, to a game piece and method of employing said game piece.

2. Description of Related Art

The game of football has been a popular activity for people of all ages for many years. The object of the game of football is for an offensive team to advance a ball, by running or passing, along a playing field until an offensive player is able to cross a goal in possession of the ball (touchdown) or kick the ball through a designated goal post (field goal). Offensive teammates act as obstructions (blockers) of opposing defensive players. Defensive players attempt to stop the progress of the ball-carrier by touching or tackling the ball-carrier. The game is generally designed to have eleven offensive and eleven defensive players.

A disadvantage of conventional football is that the participants' options are limited and variations of the game are less challenging when fewer than eleven players are available per team. Unfortunately, it is not always possible to arrange for 22 players at a designated time and location. With a reduced number of players, less offensive receivers will be available for a passer to throw the ball to and less defensive players will be available to thwart the passer from reaching the target. Similarly, less offensive blockers will exist to serve as an obstacle to pursuing defensive players and less defensive obstacles will exist for offensive players to avoid while advancing the ball.

As with football, games such as soccer, basketball, hockey, rugby and the like are designed to be played with a number of participants. Again, as with football, there are few options as to how these games may be played to accommodate a lesser number of available participants than generally required.

Game pieces are rare in the area of field games. U.S. Pat. No. 3,675,921 to Meyers describes a life sized basketball player with a motor to direct arm movement. The device is designed to provide a distracting obstacle for a human basketball player. However, this device is not suitably designed for contact with a human player or the game ball. Human contact with this device may well inflict pain or injury to a human participant. No known game piece is structurally adapted to interact with human game participants serving as both obstacles to humans and as targets for humans.

Board games intended to simulate field games are known. Many board games employ game pieces intended to simulate human participants of a field game. However, these game pieces are generally too small and structurally inadequate to interact as simulated players with human participants in a field game.

SUMMARY OF THE INVENTION

It is an object of the present invention to provide a variation of field games, such as football, that can be played by less than the generally required number of players.

Another object of the present invention is to provide a variation of field games, such as the game of football, that is safer than traditional field games.

A further object of the present invention is to provide a game piece for use in field games which game piece is structurally adapted to interact with human participants in field games.

The foregoing objects and advantages are obtained by the present invention in which game pieces are provided to represent human players in a field game. The game pieces comprise a base adapted to rest on a playing field, a support means for supporting a figure in a generally vertical position, and a figure having a height of at least a foot, a width of at least 6 inches, and a thickness of at least 0.5 inches.

One manner in which the game piece of the present invention may be employed is by providing two teams, each comprising at least one game piece. The game pieces are positioned on a playing field. A game piece of the second team is employed by a human participant in the field game as a target at which he can propel an object. The game piece of the first team is used as an obstacle for a human participant of the field game.

DETAILED DESCRIPTION OF THE ILLUSTRATED EMBODIMENT

Figure 1:
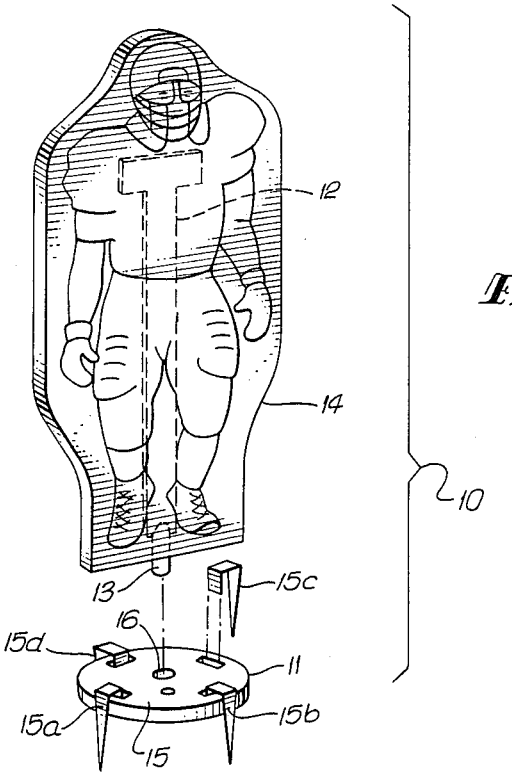
FIG. 1 is an exploded isometric view of a first embodiment of a game piece according to the present invention.

The present invention concerns a game piece and method of employing the game piece to simulate a human participant in a field game involving human players. The present invention can best be understood by reference to the accompanying drawings in which FIG. 1 represents a game piece 10 of the present invention.

Game piece 10 comprises a base 11 adapted to rest on a playing field and to receive a support means 12. Support means 12 is adapted to be received by the base 11 and to support a FIG. 14, connected to the support means 12, in a generally vertical position. FIG. 14 is connected to the support means 12 and has a height of at least 1 foot and a width of at least 6 inches. FIG. 14 has a thickness of at least 0.5 inches and possesses structural integrity sufficient to withstand contact with human players and propelled objects as hereinafter described.

In the illustrated embodiment the base 11 is hollow and defines a hole 15 in the top of the base 11. The hole 15 allows the hollow base 11 to be filled with a relatively dense material such as sand or water. This enables the game piece to stand more stabily on the playing surface, thus reducing the chance of wind or uneven terrain from dislodging the game piece from an upright position. The base 11 defines a receiving means 16 for receiving the support means 12. In the illustrated embodiment the receiving means comprises a generally circular opening defined by the base 11. The game piece 10 further comprises spikes 15*a–d* for securing base 11 to the playing surface. In the illustrated embodiment, the spikes 15*a–d* are adapted to be received by the base 11 and pressed into the playing surface. Specifically, the base 11 defines openings 17 that are adapted to receive the spikes 15*a–d*.

In the illustrated embodiment, support means 12 comprises an elongated member attached to the FIG. 14. Support means 12 is adapted to be received by the base 11. Specifically, the support means 12 comprises an end portion 13 adapted to be received by receiving means 16 defined by base 11. Upon the application of a pre-determined force, the end portion 13 of the support means 12 will disconnect from receiving means 16, thereby reducing the chance of breakage upon application of excessive force upon the interconnecting joint.

FIG. 14 is connected to the support means 12. In the embodiment illustrated in FIG. 1, support means 12 connects to FIG. 14 by extending through a portion of the interior of FIG. 14. Other suitable means for connecting the figure to the support means will be apparent to those skilled in the art. Exemplary of other suitable means are adhesive materials, brackets, fasteners and the like. FIG. 14 has a height of at least about 1 foot, a width of at least 6 inches and a thickness of at least about 0.5 inches. The preferred embodiment of FIG. 14 will be the approximate size of a human participant in the field game. To better simulate the game, FIG. 14 preferably is in the shape of a player or bears a team logo.

In the illustrated embodiment, the support means 12 is adapted to bend upon application of a predetermined force and resiliently return to its original position. The support means is formed from a material having sufficient strength to support the weight of FIG. 14 and capable of resiliently bending as described above. Alternatively, support means 12 may further comprise a spring-like device which enables the described resilient bending action. Those skilled in the art will appreciate other means for accomplishing the resilient bending. The resilient bending motion of the game piece lessens the force of impact should a human participant contact the game piece.

Those skilled in the art will also recognize that the base 11 can be fabricated in a variety of manners from a variety of materials. For example, base 11 can be injection molded or thermoformed from a thermoplastic or thermosetting polymeric resinous material such as polyethylene, polypropylene, polyurethane, styrene, ABS, and the like. Any method of forming base 11 and any material are suited for use in the present invention provided base 11 possesses the physical characteristics which allow it to function in the manner described.

Those skilled in the art will realize that the support means can be fabricated in a variety of manners from a variety of materials. For example, the support means can be injection molded, thermoformed or cut from a organic resinous material having a desirable degree of flexibility, resiliency and strength.

Alternatively, if a spring is used to accomplish the desired flexibility, any sturdy material could be used to form the support means. Many of the materials suitable for use in forming the base can be used to form the support means. Spikes 15*a–d* can be formed in a manner and from materials similar to those used to form the support means.

FIG. 14 is suitably formed from any material capable of performing the described function. FIG. 14, in the illustrated embodiment, is formed of a material durable enough to withstand contact with propelled objects and human participants, yet soft enough to provide some cushioning for a human participant who contacts it. The FIG. 14 is also preferably composed of a lightweight material to ease transportation of the game piece 10. Known materials possessing the desired features include foamed and unfoamed thermoplastic and thermosetting polymeric resinous materials as well as paper products.

Figure 2:
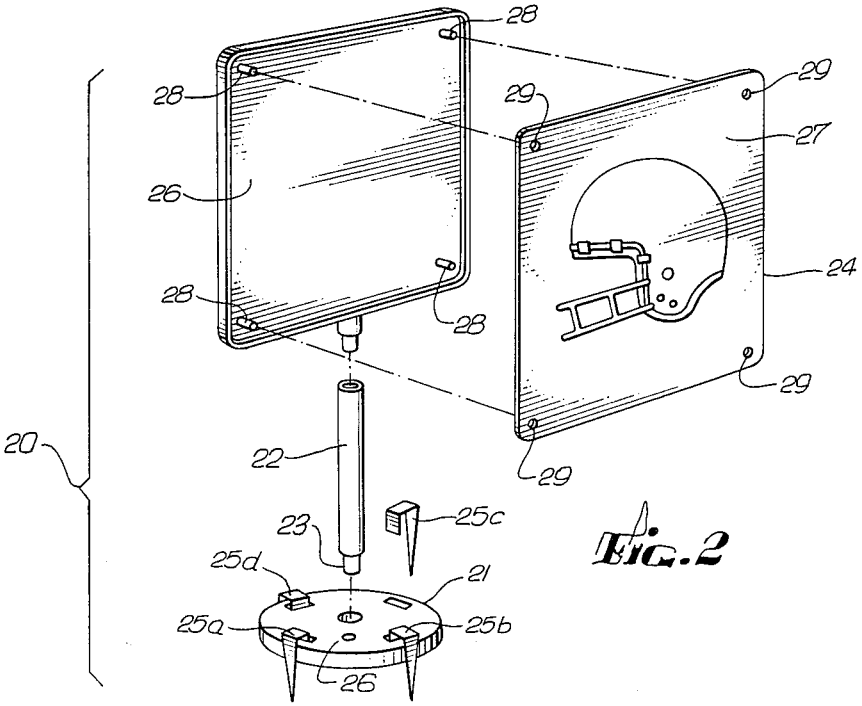
FIG. 2 is an isometric view of a second embodiment of a game piece according to the present invention.

FIG. 2 represents an alternative embodiment of game piece 10 of the present invention. Game piece 20 comprises the same three elements as the game piece of FIG. 1: a base 21, a support means 22, and a FIG. 24. The base 21 possesses the same characteristics and may be formed from the same materials and in the same manner as described in connection with the base of FIG. 1. Indeed, the game pieces of FIGS. 1 and 2 employ identical bases.

The support means 22 is in an elongated generally tubular shape. The support means 22 is detachably connected to the base 21 and an end portion 23 of FIG. 24. Hence the three components could be easily disassembled to facilitate transportation of the game. As described in connection with the support means of FIG. 1, the support means 22 may be formed from a variety of materials.

FIG. 24 is formed in a generally square shape defining a flat surface to enable the placement of a team logo or emblem on its outer surface. FIG. 24 is shown as comprising two separate pieces, a back plate 26 and a front plate 27. The back plate 26 has a peg 28 in each of its four corners. The front plate 27 has a recessed area 29 in the shape of the pegs in each of its four corners. The two plates may be joined through the union of the corresponding pegs and holes. FIG. 24 may be formed from any of the materials discussed in connection with the FIG. 14 of FIG. 1.

Figure 3:
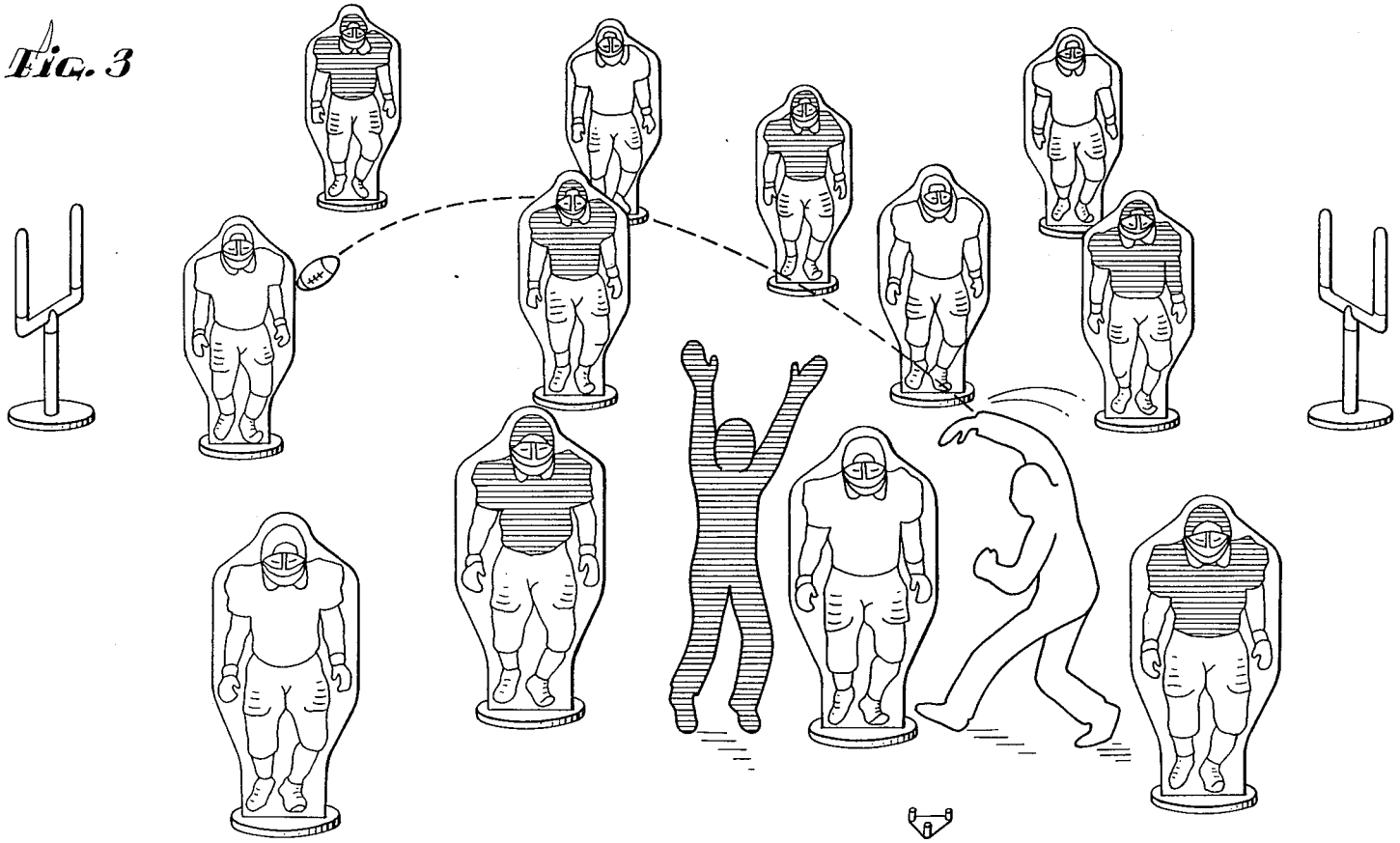
FIG. 3 is a perspective view of a playing field upon which a plurality of game pieces according to the present invention are located.

Referring to FIG. 3, the implementation of the method of a field game using the game piece of FIG. 1 is illustrated. A playing field is illustrated which field is preferably outdoors and suitable to allow human participants to run about during the playing of varied field games. FIG. 3 illustrates use of the game pieces of FIG. 1 to simulate human participants in the field game of football. The goal of football is for one player to cross a designated goal line and thereby score a touchdown. The touchdown may also occur by completing a pass to a human teammate who has crossed the goal line or by completing a pass, by throwing a ball to, and contacting a game piece positioned across the goal line and representing the same player's team. The team with the most points at the end of a designated period of time wins.

Two distinguishable sets of playing pieces are provided to represent an offensive and a defensive team. Each play commences formally after each team has placed their alloted game pieces in strategic positions. At this point, a human participant on the offensive team has the option to either run or pass the ball. During the running play, the offensive player runs the ball forward until stopped in a predetermined fashion by a human participant on the defensive team, or until the offensive player bumps into a game piece representing the opposing team. The offensive player utilizes his own game pieces as obstacles since an opposing player may not crash through the offensive game piece in the pursuit of the offensive player. On a passing play, the offensive player may either throw the ball to another human participant, or to an offensive game piece. Upon successfully hitting his own game piece with a pass, the offensive team is credited with a pass reception. Again the offensive player utilizes his own game pieces by standing immediately behind the game piece teammate who acts as a blocker/obstruction to prevent an opponent from contacting the passer before he releases the pass.

As in American football, a human offensive player can elect to punt at any time. Upon a punt, the game pieces act as blockers and tacklers such that a defensive player may not contact a game piece, and once an offensive player makes contact with a game piece of the opposing team, he is deemed tackled.

It can be seen from the above that the game pieces of the present invention are ideally suited to solve the particular problems of field games as hereinbefore stated.

For example, when less than two complete teams of players are available to play traditional football, the game pieces provide an increased number of manners of advancing a ball or similar object across a playing field. The game pieces serve as additional targets for a offensive player to throw to and a defensive player to defend against. These game pieces can also be positioned as offensive blockers to serve as an obstacle so that an offensive player can avoid being touched by a defender.

The game can be adjusted for use in other ball-advancing sports, such as soccer, basketball, hockey, and rugby. The game pieces can be used in these sports as obstructions to be avoided during play and as targets to be contacted during play.

The game pieces according to the present invention make possible that the game can be a safer game than the traditional field games. The free-standing game pieces are composed of a padded, light structure that bends upon contact. Therefore, when a live defender makes contact with this game pieces in the course of a game, the player will receive a less jarring blow than would occur from contact between two human players.

The game pieces are uniquely able to withstand contact during the course of the game. The game pieces feature a resilient support means that does not resist contact; instead, the support means merely bends upon contact and returns to its initial position. If excessive contact, beyond a pre-determined level, occurs upon the game piece, the support means will detach from its base, thereby helping to prevent the breaking of the game piece.

It will, of course, be understood that modifications of the present game, and game piece in its various aspects, will be apparent to those skilled in the art, some being apparent only after study and others being merely matters obviously related to the present game. As such, the scope of the invention should not be limited by the particular embodiment herein described, but should be defined only by the appended claims and equivalents thereof.

I claim:

1. A game piece adapted for placement on a playing field suitable for humans, said game piece comprising:

a base adapted to rest on a playing field;

a figure having the approximate size of a human;

support means for supporting the figure in a generally vertical position, said support means having a vertical axis about which said support means is adapted to bend upon application of a predetermined force and thereafter resiliently return to its original position, said support means having an elongated shape extending along a portion of said figure; and means removably connecting said support means to said base for permitting said support means to become disconnected from said base when said figure is impacted with a predetermined force.

2. The game piece of claim 1 wherein said base is hollow and adapted to be filled with a relatively dense material.

3. The game piece of claim 1 wherein said game piece is manually positionable at different locations of said playing field by a human.

4. The game piece of claim 3 wherein said figure is formed from a composition selected from the group of thermoplastic and thermosetting polymeric resinous materials and paper products.

5. The game piece of claim 4 wherein said figure is formed from a composition selected from the group consisting of polystyrene foam or polyurethane foam.

6. The game piece of claim 1 wherein said figure has the shape of the outline of a sports player.

7. The game piece of claim 1 wherein said figure possesses a pictorial representation of a sports player.

8. The game piece of claim 1 wherein said figure is adapted to simulate selected functions of a human player engaged in a game, said functions including a target function and an obstacle function.

9. A method of playing a field game in which at least two human participants perform activities which form a normal part of the game, said method comprising:

providing a first team having at least one human participant and at least one stationary game piece having the approximate size of a human participant;

providing a second team having at least one human participant and at least one game piece having the approximate size of a human participant;

positioning the game pieces of said first and second teams at fixed locations on the playing field and maintaining the game pieces at those positions during at least one phase of the game;

employing a game piece of the first team as an obstacle to the human participant of the second team; and employing a game piece of the second team as a stationary target at which a human participant of the second team can propel an object employed in the play of the game.

10. The method of claim 9 wherein the game pieces of the first and second teams comprise:

a base adapted to rest on said playing field;

a support means for supporting a figure in a generally vertical position, said support means being connected to said base; and a figure connected to said support means.

11. The method of claim 10 wherein the second team comprises two or more game pieces and further wherein a game piece of the second team is employed as an obstacle for a human participant of the field game.

12. The method of claim 10 wherein the first team comprises two or more game pieces and further wherein a game piece of the first team is employed as a target at which a human participant of the field game propels an object.

* * * * *